US006182714B1

(12) United States Patent
Ginsburgh et al.

(10) Patent No.: US 6,182,714 B1
(45) Date of Patent: Feb. 6, 2001

(54) FUEL SAFETY MANAGEMENT SYSTEM FOR STORING, TRANSPORTING, OR TRANSFERRING HYDROCARBON FUEL

(76) Inventors: Irwin Ginsburgh, 24125 Clearbank La., Santa Clarita, CA (US) 91321; Clyde LeRoy Tichenor, 6470 La Cumbre, Somis, CA (US) 93066; Darrell Jay Metcalf, 905 N. Oak Ave., Fillmore, CA (US) 93015

( * ) Notice: Under 35 U.S.C. 154(b), the term of this patent shall be extended for 0 days.

(21) Appl. No.: 09/289,861

(22) Filed: Apr. 12, 1999

Related U.S. Application Data

(60) Provisional application No. 60/081,580, filed on Apr. 14, 1998, and provisional application No. 60/081,625, filed on Apr. 14, 1998.

(51) Int. Cl.[7] ..... B65B 1/04
(52) U.S. Cl. ..... 141/63; 169/26; 169/62
(58) Field of Search ..... 141/63, 64, 65, 141/66, 98; 169/26, 61, 62, 84

(56) References Cited

U.S. PATENT DOCUMENTS 3,788,039 * 1/1974 Bragg .
3,838,576 * 10/1974 Geffs .

* cited by examiner

*Primary Examiner*—Steven O. Douglas

(57) ABSTRACT

A safety-enhancing management system for storing, transporting, or transferring hydrocarbon fuel whereby inert gas conveyance provides hydrocarbon fuel receptacles with a combustion suppressing volume of inert gas which displaces potentially combustible fuel vapor/air mixtures which can otherwise collect in the ullages of such receptacles. In one embodiment the inert gas is readily stored, transported, and conveyed in an inert gas-enriched fuel that degasses inert gas from the fuel within one or more receiving receptacles ullage(s). In a second embodiment, a separate controllable supply of inert gas, such as carbon dioxide, is storable in one or more gas receptacle(s), in a gaseous or liquefied state. The inert gas from one or more fuel receptacle(s) is conveyed via a controllable gas conveyance and wherein such conveyance may also be aided by such gas control as a computer controllable valve, and/or pump, or by the employment of a heat device to facilitate the change of state expansion of the inert gas that is stored in a liquid state. Excess inert gas liberated from within the gas-enriched fuel can optionally be captured and may be pumped back into various fuel receptacle(s), or can be re-stored in the gas receptacles in any state in these fuel systems and as also may be placed aboard aircraft.

30 Claims, 5 Drawing Sheets

FUEL SAFETY MANAGEMENT SYSTEM FOR STORING, TRANSPORTING, OR TRANSFERRING HYDROCARBON FUEL

This is a non-provisional application that relies on provisional patent Nos. 60/081,580 and 60/081,625 filed Apr. 14, 1998.

OVERVIEW OF THE INVENTION

1. Field of the Invention

The present invention relates generally to a safety management and control system of hydrocarbon fuel which employs inert gas, of a type which is absorbable in hydrocarbon fuel, under controllable conditions, in a ratio that exceeds 0.1 volume of gas per volume of liquid fuel, and is also of a type under other controllable conditions which is suitable for filling an ullage of flammable fuel receptacles with a combustion suppressive medium, whether such a medium is contained in fuel, or contained separately in the system in a gaseous or chilled state, and subsequently released as an inerting gas into one or more fuel receptacle ullage.

2. Background of the Invention

In copending patents, the means are described to create a variety of gas-enriched fuels—suitable for use in various types of vehicles, engines, and fuel-burning devices. The fuels are processed in any of a variety ways to absorb an optimal amount of inert gas within the fuel itself, such that the inert gas contained therein can subsequently degas within the fuel receptacles that store the fuels—and when conveyed with an optimum concentration of inert gas such as CO2 to a fuel-burning device such as an engine, can substantially reduce harmful emissions and/or improve engine combustion. Numerous techniques are disclosed in the pending patents for absorbing or retaining inert gas within the gas-enriched fuels including means for: mixing, stirring; atomizing, aspirating, pressurizing, agitating, splashing, carbonating, diffusing, convecting the gas within the fuel (gas absorption in the fuel can also be effected by establishing or maintaining an equilibrium relationship between an ullage inert gas concentration and a desired concentration of inert gas within the fuel. Conversely, many of these same techniques can be used to degas inert gas (such as CO2) from fuel. A key feature of the inert gas-enriched fuel is its capacity to degas over time and according to known or predictable conditions. Thus, one inert gas conveying means for delivering inert gas into receiving fuel receptacles is to convey gas-enriched fuel into a particular receptacle whereafter the inert gas will degas from the fuel and provide an inerting medium within the ullage of the fuel receptacle. A second inert gas conveying means of the present invention is achieved by employing one or more inert gas receptacles coupled by suitable conduit to one or more fuel receptacles and controlling the flow of inert gas (e.g. with a computer controllable pump and/or valve) to the receptacle(s) according their monitorable ullage conditions. Receptacles for storing and managing liquefied or solidified inert medium are also disclosed. The fuel safety-enhancing system of the present invention provides practicable methods to increase the safety of a variety of fuel receptacle types, such as those used in vehicles which carry or transport combustible fuels, or those used for ground-based or stationary fuel storage, are disclosed. Thus, an effective inert gas conveyance to the ullages of fuel receptacles is provided which displaces potentially flammable ullage contents with a sufficient volume of inert gas to substantially increase the fuel storage safety of contents within fuel receptacles—contents that can otherwise be comprised of flammable vapor/air mixtures.

The co-pending patents also site the carbon dioxide (CO2) absorbing characteristic of hydrocarbons such as kerosene which is the principle combustible agent in fuel for jet aircraft, and further describe the degassing process of CO2 which, when initially contained within the jet fuel, is released from the fuel into the fuel receptacle over time, according to a number of controllable and/or predictable factors, and thus replaces the ullage volume typically filled with potentially combustible fuel vapor/air mixture with the de-gassing inert gas. Since it is commonly understood that below the stoichiometric level, the combustive danger of fuel receptacles is proportional to the amount of fuel vapor/air mixture within such receptacles, it is desirable to reduce or eliminate such mixtures to an effective degree possible. An improved method for managing and controlling inert gas within flammable fuel receptacle is disclosed in the present invention and is described in detail below.

Heretofore, some systems of managing inert gas in aircraft fuel systems have been employed. For example, a limited number of aircraft have used large storage tanks to store gaseous nitrogen under high pressure that is subsequently released into the fuel tank ullage during the flight of the aircraft. However, due to the large volume capacity of the aircraft fuel tanks, the on-board nitrogen tanks—as a sole source of inert gas—did not prove to be practical. Similarly, a Dewar system approach has been employed on some cargo aircraft to store liquid nitrogen for subsequent release during the flight, but due to problems relating to thermal shock, due to the extreme cold of liquefied nitrogen the Dewar system has not proven to be an effective solution to the needs of typical commercial aircraft and the like. By contrast, some chilled inert medium such as CO2 can be stored close to a temperature range that is encountered by commercial aircraft at higher cruising altitudes (e.g. CO2 that is liquefied, or solidified). Liquid nitrogen cannot be stored in this temperature range and consequently additional handling is required to prevent thermal shock to fuel systems attempting to incorporate the considerably colder liquid nitrogen. Another safety-enhancing method employed on vehicles such as jet aircraft are on-board inert gas generators that are expensive and need improved reliability.

Attempts to overcome the aforenoted problems have been made in the several patents which employ methods to remove or 'scrub' oxygen from either: gas mixture having a large concentration of nitrogen; or, from the fuel itself, in order to reduce fuel tank ullage flammability. For example, U.S. Pat. No. 4,378,920 issued to Runnels et al, discloses an inert gas generator which removes oxygen to produce a nitrogen rich gas. Similarly, U.S. Pat. No. 3,691,730 issued to Hickey et al describes a method for scrubbing dissolved oxygen from fuel. Attempts to commercialize, or to otherwise put these systems into practice have proven them to be impractical or to cumbersome, complicated and/or costly. For example, Hickey et al describe means for mixing inert gas with pumped fuel as it is received by a jet's fuel receptacle in order to remove oxygen from the fuel and thereby create an "inert fluid". However, jet fuel is typically pumped at a rate that exceeds several hundred gallons per minute. Pumps required to remove oxygen from the fuel at such rates—particularly those considered for on-board use (i.e. on the aircraft)—would likely be very bulky and not practical for integration in the aircraft's fuel system.

By contrast, the present invention provides inert gas conveyance means which employs inert gas of a type which is readily and inexpensively mixed or absorbed into the fuel before the fuel is loaded onto a vehicle, or is stored in one or more separate gas receptacle for subsequent conveyance into one or more fuel receptacles as needed (and can readily be stored under pressure in a chilled or gaseous state). It is noted that any one or more of a variety of fuel and/or gas receptacles can be employed by the fuel safety management system of the present invention, including, storage tanks, fuel tanks, fuel bladders, Dewar systems, positive pressurized tanks, negative pressurized tanks, and so forth. Thus in one embodiment of the invention, the fuel is transferred into the desired fuel receptacle(s) and the inert gas de-gasses from the fuel into the ullage of the receptacle. Alternatively, the invention discloses the employment of a plurality of receptacles with suitable coupling and receptacle content conveyance means to provide the controllable exchange of at least one receptacle content to another receptacle, including: stationary; transportable; vehicle-based; ground-based; and/or airborne receptacles (e.g. as in air tankers).

It is well known that many types of flammable fuel receptacles include vents to accommodate the expansion or contraction of gas and/or vapor/air mixtures. It is also known that the expansion of such ullage gases and/or mixtures can be caused by factors such as changes in temperature or atmospheric pressure, and while it is often desirable for the receptacles to acquire an equilibrium pressure, or near equilibrium pressure—in response to such changes—it is not necessarily desirable or optimal to vent pressurized receptacle gases into the atmosphere. For instance, it can be preferable to capture and reuse gas such as CO2 for safety-related, environmental and economical reasons. The present invention provides means for re-cycling and managing excess CO2 and re-directing it as needed into the inert gas safety-enhanced fuel receptacles of the system.

There are deficiencies in the prior art sited above and it is the purpose of the present invention to overcome such deficiencies and to provide a hydrocarbon fuel safety management system that is economical, thermally tolerable and environmentally sensitive, and more efficient in managing one or inert gases (whether stored in a solid, liquid, or gaseous state).

SUMMARY OF THE INVENTION

The hydrocarbon fuel safety management system of the present invention comprises a plurality of receptacles having suitable receptacle content conveyance and coupling means therebetween. The system can further comprise an optional receptacle-content monitoring means to monitor the storage condition within the flammable fuel storage receptacle(s) being communicably linked with a receptacle-content conveyance means (e.g. a computer-controlled valve and/or pump) to control the flow and concentration of inert gas which is thermally tolerable within the fuel system and the ullage of fuel storage receptacle(s). The monitoring means can include any one or more in a variety of known condition sensing and monitoring instruments and/or gauges for measuring, monitoring, or reporting fuel receptacle conditions such as temperature, atmospheric pressure, fuel chemistry, ullage chemistry, fuel-to-gas volume ratios, fuel motion, and so forth. In one embodiment of the invention at least one receptacle of the system provides a volume of inert gas which is transferable via one or more connected, or connectable, conduit into the flammable fuel receptacle(s), whether the source of inert gas is contained in a gas receptacle in a gaseous state (or chilled for storage and subsequently released as a gas). In a second embodiment, the system provides inert gas conveyance to one or more fuel receptacle ullage in a gas-enriched hydrocarbon fuel, which under controllable conditions readily exceeds a ration of 0.1 volume of gas per volume of liquid fuel under ambient pressure (i.e. NPT).

The present invention is applicable to the needs of aircraft and the safety-enhancement of their fuel systems. In the gas-enriched fuel variant of the invention, one or more fuel receptacles of an aircraft is provided with a substantial volume of inert gas such as carbon dioxide (CO2) within the conveyance fuel, such that the inert gas can de-gas from the fuel into the fuel receptacle ullage under known and monitored conditions over time, such conditions being optionally monitorable by receptacle-condition monitoring means. In another variant of the invention, the system comprises a plurality of receptacles suitable for containing jet fuel and a separate volume of inert gas such as carbon dioxide (CO2), wherein the condition in the fuel receptacle is monitorable by receptacle-condition monitoring means which, in turn, is communicable with one or more inert gas conveyance means to direct inert gas to the fuel receptacle(s) as needed. In this second variant of the invention, inert gas can be added to one or more fuel receptacle of the aircraft from internally or externally located gas receptacle(s). For instance when it is desirable for the aircraft to depart with less than full fuel tanks (for shorter flights) and to also have a sufficient concentration of CO2 (upon departure) in the fuel receptacle ullage to prevent ignition of fuel vapor/air mixtures, a supply of inert gas can be pumped into the fuel receptacle(s) ullage: while the aircraft is at an airport terminal, CO2 gas can be conveyed by inert-gas conveyance means into the aircraft's fuel receptacle(s) ullage via suitable coupling with a transportable tanker containing a CO2 volume, or via one or more ground-based CO2 source. Additionally, one or more fuel receptacles of the aircraft containing jet fuel with inert gas either absorbed therein, or inert gas layered substantially thereabove, can have suitable coupling with a receptacle suitable for the storage of inert gas including chilled CO2 stored in either a liquid state under pressure or in a solid state, with such CO2 receptacle(s) having sufficient insulation means to store the chilled CO2 until a latter phase of a flight, such as an aircraft's descent phase. De-gassing of chilled CO2 can be facilitated by a heating means, including a controllable insulative environment surrounding the receptacle, to expand the liquid or the solid CO2 at a desired rate into an inert gas supplement that is several hundred times the volume of the chilled-state CO2. Inert gas stores are optionally conveyable to the aircraft's fuel receptacle(s) as need through a suitably coupled computer controlled valve and/or pump. It is noted that solid or liquid CO2 can be stored in a temperature range that is near the ambient outside air temperature of aircraft when a cruising altitude, and such outside temperatures have proven to chill aircraft fuel (such as the fuel in wing tanks) to the approximate temperature range of stored solid or liquid CO2. Thus, by storing and controlling a supply of CO2, such as chilled-state CO2, in compact, relatively lightweight receptacle(s) which require a relatively small number of cubic feet for storage but whose contents expand by a factor of several hundred times into an inert gas volume—effective ignition suppressive concentrations of inert gas within the ullage of the fuel receptacle(s) can be managed throughout the entire flight of the aircraft.

In another embodiment of the invention, the hydrocarbon fuel safety management system is configured to capture and contain excess inert gas in one or more receptacles, in order to minimize or prevent the venting of the gas from the fuel storage receptacle into the atmosphere, and is comprised of one or more inert gas receptacle suitable for containing inert gas. In the case of a commercial aircraft for example, the preparation of a flight of a jet such as a Boeing 747 can begin with a transfer of CO2 enriched fuel into the 747 fuel tanks at an airport, optionally CO2 gas can be pumped into the fuel receptacle(s) ullage. As the 747 takes off and ascends to cruising altitude, fuel is consumed and the ullage volume increases in the 747 fuel tanks. Initially, the ullage can fill with de-sorbed CO2 as several conditions including the reduction in atmospheric pressure promote the de-sorbing of the CO2 contained in the fuel. Under such conditions, the de-gassing rate may exceed the ullage volume and rather than simply venting the CO2 into the atmosphere, the fuel safety management system monitors the ullage condition and transmits controlling signals to a receptacle-content control means, such as a computer controlled pump and/or valve, to transfer the surplus inert gas into one or more inert gas receptacle suitably located elsewhere on the aircraft. Such transfers can be further facilitated by the employment of inert gas compressing and cooling means to store some or all of CO2 in a chilled state. One such location for either the inert gas receptacle(s) and/or the gas compression/cooling means on 747s, can be within the "Dry Bay" located in front of the fuselage fuel tank. Later in the flight, the 747 begins its descent, and due to the change in atmospheric pressure, begins to draw outside air in through the fuel tank vents into the fuel tanks, which in turn, compresses the ullage CO2 in a layer between the fuel and the incoming air. During this stage of the flight, it can become desirable, to increase the CO2 concentration within the fuel tank ullage to reduce the inducted air volume (which might otherwise support an ignition of fuel vapor/air mixtures) in which case the captured excess CO2 contained in the inert gas receptacle(s) can be conveyed into the aircraft's fuel receptacle(s). Thus, the volume of fuel vapor/air mixture in the fuel receptacle(s) is reduced and the safety of the vehicle (aircraft) is increased, while the CO2 volume is also economically and environmental managed.

DESCRIPTION OF THE PREFERRED EMBODIMENTS

Figure 1:
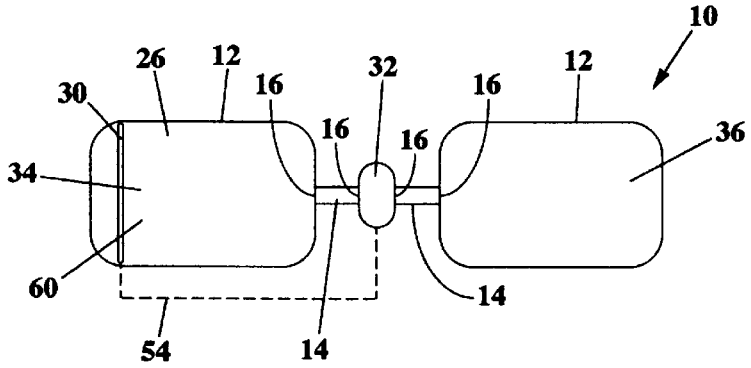
FIGS. 1–4 are diagrammatical illustrations showing conduit-coupled receptacles having a hydrocarbon fuel volume, and a controllable inert gas volume.

Referring to FIGS. 1 through 4, a fuel safety management system 10 is seen to include a plurality of receptacles 12 having suitable conduit coupling 16 with at least one conduit 14 operatively coupled therebetween. System 10 comprises at least one receptacle 12 suitable for containing a hydrocarbon fuel volume 34, or inert gas-enriched fuel volume 60, and at least one receptacle 12 having a conveyable inert gas 36 whether stored as a gas or stored within a hydrocarbon fuel. The inert gas employed by the system is of a type that is absorbable in hydrocarbon fuel, under controllable conditions, in a ration exceeding 0.1 volume of gas per volume of liquid fuel (at normal temperature and pressure 'NTP'). Optionally, the system can employ a chilled inert medium (such as liquefied or solidified CO2) which can be stored in a temperature range that is thermally tolerable with components of fuel systems such as those onboard aircraft, including arrangements to store, control and manage the inert gas under low pressure or near ambient air pressure in the inert gas receptacle. Optionally, system 10 can be further comprised of a receptacle-condition monitoring means 30 resident within at least one receptacle, which is communicably linked with receptacle-content control means 32 via monitoring means signal 54 (or via other known communication means such as any one in a variety of wireless transmission and reception devices). Accordingly, monitoring means 30, control means 32 and monitoring means signal 54 (represented in dashed lines) in combination provide a controllable inert gas conveyance means whereby inert gas is directable into the hydrocarbon fuel receptacle (s). When system 10 has the stored inert gas volume under suitably operative pressure, control means 32 includes a computer controllable valve, to control the release of the pressurized gas. Alternatively, system 10 includes a computer controlled pump, to pump the stored inert gas volume when the inert gas is at, less than, or near to, ambient air pressure.

Figure 2:
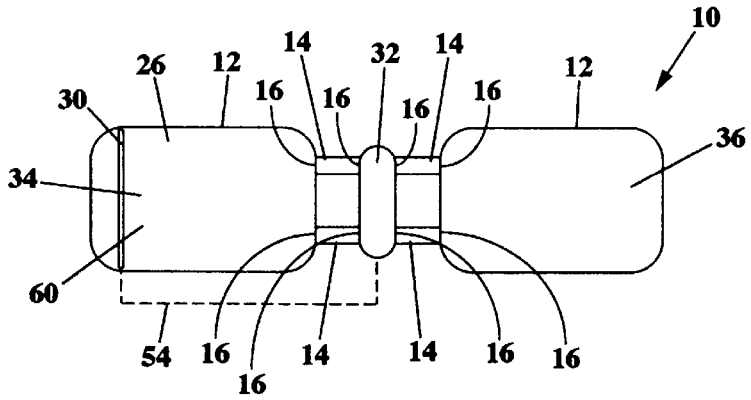
Figure 3:
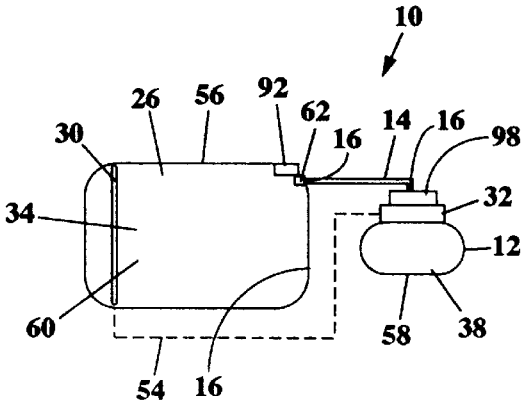
Figure 4:
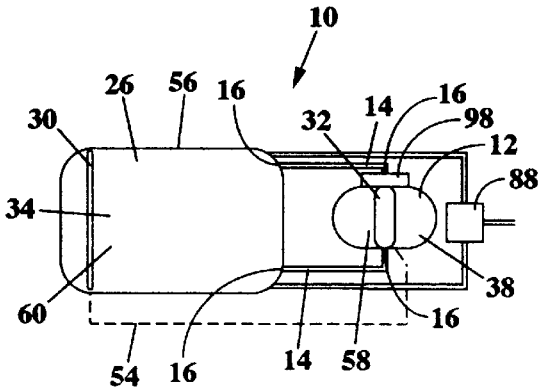

In FIG. 1 a single conduit 14 is seen coupled between two receptacles and couples with a control means 32, wherein conduit 14 can have a single passageway, or can have a plurality of passageways as can be seen in more detail in FIGS. 12 through 14 (below). FIG. 2 is similar to FIG. 1 but is seen with at least two separate conduits whose contents are controllable by control means 32. FIGS. 3 and 4 are shown illustrating at least one larger receptacle 56 for containing a volume of hydrocarbon fuel 34 or a volume of inert gas enriched fuel 60, and at least one smaller compact inert gas receptacle 58 with receptacle-content control means 32 which provides inert gas conveyance through at least one conduit 14 coupled therebetween. Compact inert gas receptacle 58 is relatively lightweight and is suitable for containing a chilled inert medium 38 (e.g. in a solid or liquid state). In FIG. 3, the chilled inert medium is expelled as a gas at a controllable rate and is conveyed into the ullage of the larger receptacle 56 by control means 32 via at least one conduit 14 in accordance with the monitored condition of the ullage and the safety requirements thereof. When the inert gas concentration within the ullage reaches an operative and safe level, the control means 32 ceases the conveyance of the gas until more gas is required. In FIGS. 1 through 4 it is noted that control means 32 can alternatively be configured with a two-way pump, or a two-way valve, to either control the conveyance of receptacle-content bi-directionally as needed through a single conduit, or bi-directionally through at least two conduits. For example, a first storage receptacle 12 initially containing a volume of hydrocarbon fuel 34 such as a storage tank or a storage receptacle aboard a fuel transportation vehicle, can be connected by a suitable conduit 14 having at least two passageways to a second receptacle 12 substantially containing inert gas, such as a commercial aircraft after it has landed, or a military aircraft connected by the conduit to a fuel tanker. In which case, as control means 32 pumps fuel through at least on passageway of the conduit into the aircraft receptacle, either a positive pressure in the aircraft receptacle ullage occurs (as the receptacle receives the fuel) which is sufficient to transfer inert gas back into the newly formed ullage of the first receptacle and/or a control means 32 such as a pump can be employed to facilitate the inert gas exchange through a second passageway of the conduit.

In another arrangement of the system, excess de-gassing from the inert gas-enriched fuel can occur, for example during the ascent phase of an aircraft's flight, due to decreased ambient air pressure, such that the volume of the inert gas can exceed the available ullage volume of a first receptable 12 and seek a venting from one or more receptacle vent 92 as the outside pressure decreases. Such excess inert gas is instead conveyed by the system to be stored in a second receptacle 12 by receptacle-content control means 32 according to signal received from receptacle-condition monitoring means 30. Therefore the captured excess inert gas is economically and environmentally managed and can be re-employed during the latter stage of a flight such as the aircraft's descent phase. As the aircraft descends, an inert gas store is conveyed back into the first receptacle's ullage in order to augment the inert gas layer which otherwise becomes compressed by increased ambient air pressure as the aircraft descends. Alternatively, the captured excess inert gas can first be routed by suitable gas conveyance means through a compressing and cooling means to chill the inert gas into either a liquid or solid state for compact and relatively lightweight storage in one or more suitable receptacle (not illustrated). Thus, the receptacle-content control means 32 herein described can convey receptacle content according to monitored receptacle conditions, unidirectionally or bi-directionally between at least two receptacles through a single passageway conduit, or bi-directionally between at least two receptacles through a conduit having at least two passageways. Additionally, it can be advantageous to convey a supply of inert gas into a fuel ullage in proximity to the receptacles vent(s) to facilitate the mixing of inert gas with the induced outside air, in which case, one or more inert gas supply aperture such as a jet mixer 62 can be mounted in proximity to the receptacle vent(s).

Figure 5:
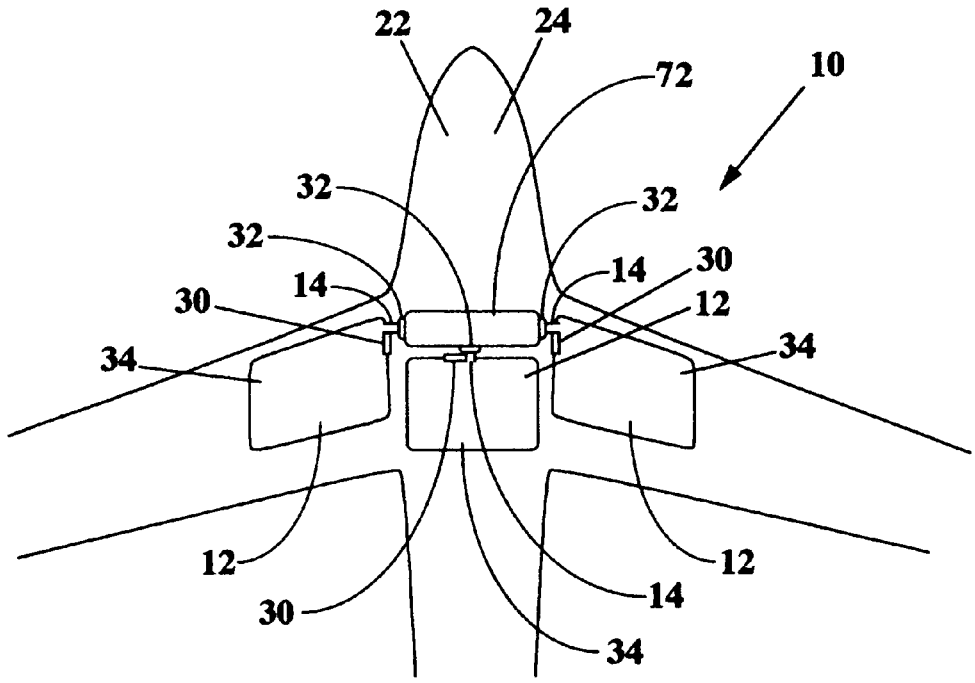
FIG. 5 is a diagrammatical illustration of an engine-powered vehicle showing a plurality of conduit-coupled receptacles.
Figure 6:
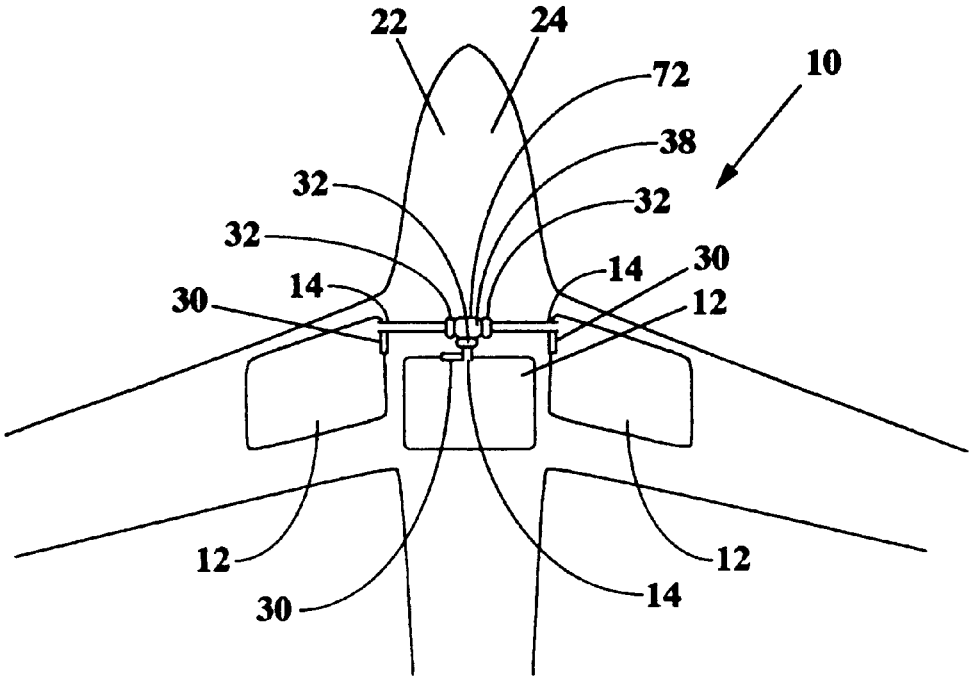
FIG. 6 is a diagrammatical illustration similar to FIG. 5 with a compact inert gas receptacle for containing a chilled inert medium.
Figure 7:
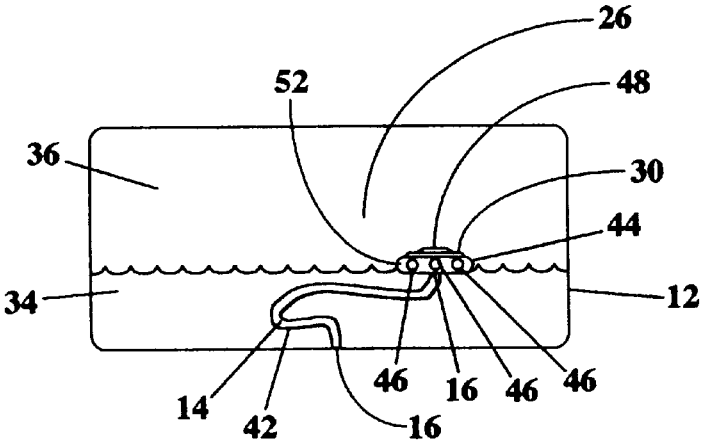
FIG. 7 is a diagrammatical illustration showing a cross-sectional view of a fuel receptacle with a fuel and gas dispensing float apparatus resident therein.
Figure 8:
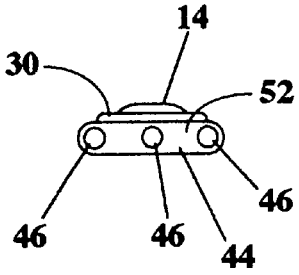
FIG. 8 is a side view of a receptacle float apparatus similar to the type shown in FIG. 7.
Figure 9:
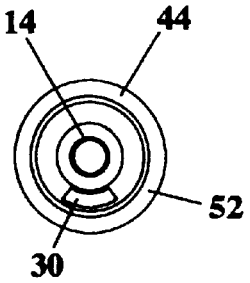
FIG. 9 is a top view of a receptacle float apparatus having an inert gas aperture and a receptacle-condition monitoring means.
Figure 10:
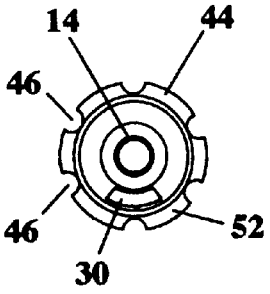
FIG. 10 is a top view of a receptacle float apparatus similar to FIG. 9 having fuel apertures radially disposed about its perimeter.
Figure 11:
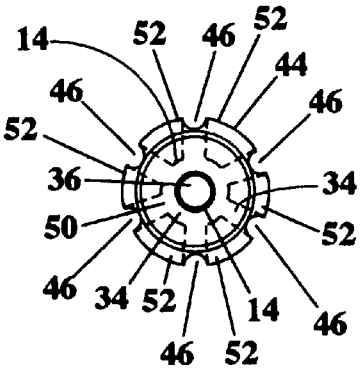
FIG. 11 is a top view similar to FIGS. 9 and 10 illustrating a fuel conduit manifold (shown in dashed lines).

Referring to FIGS. 5 and 6, a plurality of receptacles 12 of hydrocarbon fuel volumes 34 with receptacle-content monitoring means 30 resident therein, are depicted in a vehicle 22 (aircraft 24) with inert medium supply/buffer receptacle 72 having conduit 14 and receptacle-content control means 32 coupled therebetween. In the case of an aircraft, for example, inert buffer receptacle 72 can contain an inert medium upon departure (to be used as needed throughout a flight), whether stored in a solid, liquid, or gaseous state, and as is seen if FIG. 6, receptacle 72 can also be relatively compact and lightweight when storing or managing a chilled inert medium 38. For example, some inert media stored in a solid or liquid state expand by several hundred volumes when converted into gas (e.g. CO2), in which case, a store of a few cubic feet of chilled inert medium would suffice when the system is used to augment an inert gas supply which de-gasses from inert gas enriched fuel, and 20 cubic feet or less (an approximation for larger aircraft) of a chilled inert medium could suffice when the system is used with untreated jet fuel.

Alternatively, buffer receptacle 72 seen in FIG. 5 may be void of inert gas upon the aircraft's departure and as the aircraft ascends any excess inert gas which de-gasses from inert gas-enriched fuel can be stored in the receptacle 72 (including liquid or gaseous storage under pressure) to be re-employed in a later phase of the flight, such as the descent phase. Excess inert gas within the gas-enriched fuel can optionally be captured by an inert gas purging means and pumped back into the fuel receptacle(s), or can be re-stored in the gas receptacle(s) in either a gaseous state, or, when also chilled by a gas cooling and compression means can be stored in a liquefied, or solidified state in fuel systems—such as those on-board aircraft—where chilled gas is deemed thermally tolerable by the respective fuel and/or gas storing and conveyance parts of the system. The gas purging or the gas-enriched fuel may be advantageous when a particular concentration of inert gas (such as CO2) within the fuel is known to be optimal for improving performance, and/or reducing emissions of a fuel-burning device, such as an engine. Accordingly, any in a variety of gas-purging (or degassing) means can be employed to facilitate fuel degassing conditions such as those means which are known to effect changes in: pressure; temperature; agitation; and so forth. For example, a pressure purging means—using negative pressure—is achieved with a converging and diverging nozzle arrangement whereby gas-enriched fuel is conveyed through the nozzle and the gas can be extracted (e.g. at a low pressure site of the nozzle) and directed to one or more storage receptacles. Alternatively, temperature increase caused by a suitable heating means (e.g. at least one conduit of gas-enriched fuel in proximity to a warmer part of an engine) facilitates gas purging. Another gas purging means is achieved using agitation of the gas-enriched fuel by external or internal agitation means, including agitation of the fuel with high-volume ambient air. For example, at least one receptacle having a store of gas-enriched fuel and at least one controllable opening which directs a pressurized flow of ambient air through the fuel, with at least one controllable opening to channel the escape of inert gas and the pressurized ambient air. The pressurized air can be achieved by an air pump means, or by tapping some of the airstream through which a relatively fast moving vehicle moves.

With reference to FIGS. 7 through 11, at least one storage receptacle 12 is seen to include a conduit float 44 to facilitate in the transference of an inert gas volume 36 or hydrocarbon fuel volume 34. The float comprises at least one float aperture 46 and at least one conduit 14 (or plural conduit 42) attached thereto for the conveyance of receptacle-content. The conduit float 44 further comprises at least one float buoyancy chamber 52 suitably sized to suspend the float on the surface of hydrocarbon fuel volume 34 resident in the receptacle. Alternatively, float 44 may further comprise a float fuel manifold 50 having a plurality of float fuel apertures 46 for the conveyance of hydrocarbon fuel. Other variants of the aforementioned float 44 further include a receptacle-content control means (not shown in FIGS. 7–11) via monitoring means signal 54 (or via other known communication means such as any one in a variety of wireless transmission and reception devices). In operation, receptacle conditions, such as the concentration of inert gas resident within the ullage of at least one fuel receptacle, is monitored by monitor means 30 and is reported via monitoring means signal 54 to control means 32 which in turn controls the conveyance of receptacle-content until safety-enhanced inert gas concentrations are monitored and approved by the receptacle-condition monitoring means.

Figure 12:
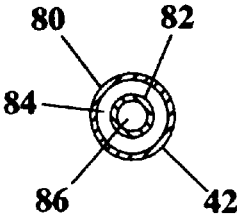
FIG. 12 is a cross-sectional view of concentric conduits with a first conduit suitable for transferring a volume of fuel and a second conduit suitable for transferring a volume of inert gas.
Figure 13:
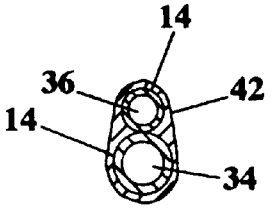
FIG. 13 is a cross-sectional view of longitudinally aligned conduits with a first conduit suitable for transferring a volume of fuel and a second conduit suitable for transferring a volume of inert gas.
Figure 14:
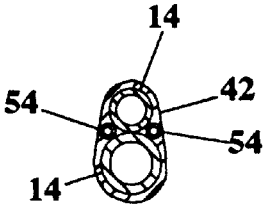
FIG. 14 is a cross-sectional view of longitudinally aligned conduits similar to FIG. 13 incorporating at least one conductor of a monitoring means signal.

In FIGS. 12 through 14, plural conduits 42 are seen in cross-sectional views, with FIG. 12 having an outer receptacle-content passageway 84 within an outer conduit 80, and an inner passageway 86 within an inner conduit 82, wherein the conduits are concentrically configured. In FIG. 13 a plurality of conduits 14 are aligned longitudinally within plural conduit 42 such that a volume of inert gas 36 is conveyable through a conduit 14, and a hydrocarbon fuel volume is conveyable through a conduit 14. FIG. 14 is similar to FIG. 13 and further includes at least one monitoring means signal conductor 54 which is adjoinable at one end to a receptacle-condition monitoring means and adjoinable at an opposite end to a receptacle-content control means.

Figure 15:
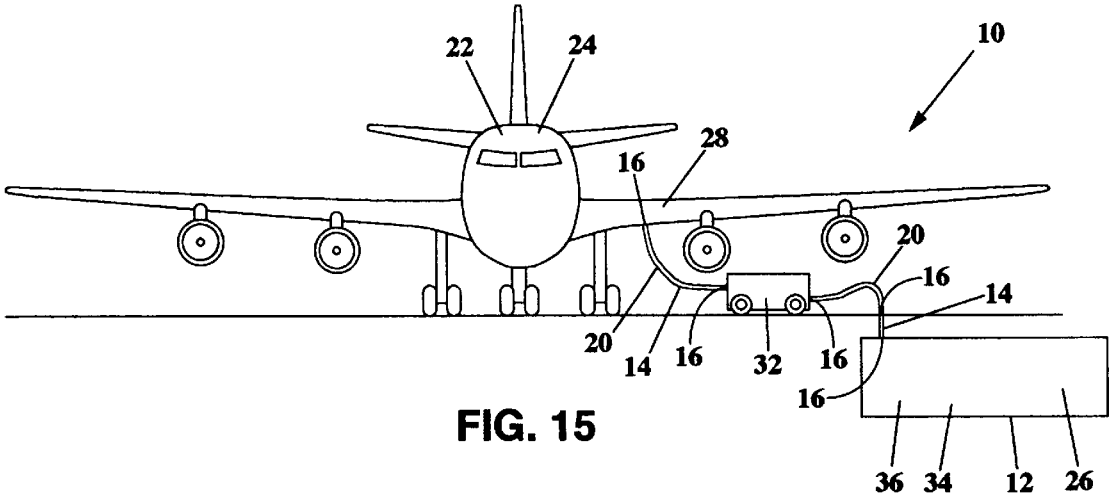
FIG. 15 is a front view of an engine-powered vehicle and an underground receptacle shown with conduit connection therebetween.
Figure 16:
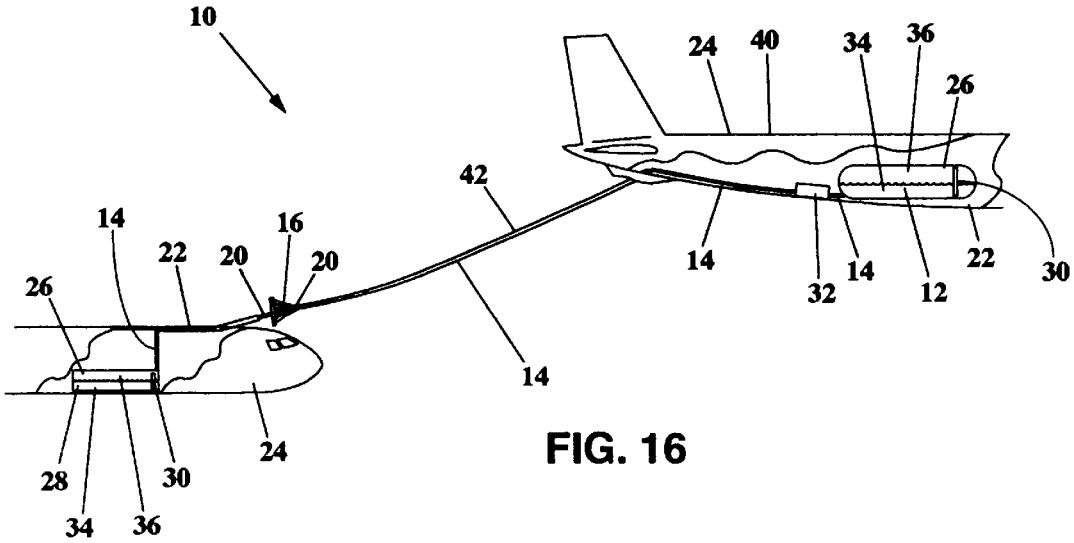
FIG. 16 shows conduit-coupled receptacles with a first receptacle in a mobile tanker vehicle and a second receptacle in a second vehicle.

Referring to FIG. 15, a plurality of receptacles is seen to include a vehicle-contained receptacle 28 (such as an aircraft wing tank) and a storage receptacle 12 with conduit 14 having conduit connections 16, (it is noted that plural conduit 42 can alternatively be employed instead of conduit 14) and receptacle-content control means 32 controlling the conduit content therebetween. As previously mentioned, the receptacle-content control means 32 can convey receptacle content according to monitored receptacle conditions, unidirectionally or bi-directionally between at least two receptacles through a single passageway conduit, or bi-directionally between at least two receptacles through a conduit having at least two passageways—and can do so in systems which employ inert gas enriched fuel, or in systems which employ conventional hydrocarbon fuel which is safety-enhanced by added inert gas. Thus, a vehicle 22 (aircraft 24) employing the fuel safety system lands and taxiis to a re-fueling location, control means 32 is connected via coupling connection(s) 16 to at least one conduit 14 (or plural conduit 42), and a controllable inert gas volume(s) in vehicle 22 is conveyed from the vehicle-contained receptacle(s) 28 into a suitable storage receptacle 12. Thereafter, a controllable volume of fuel (gas-enriched or non-treated) is pumped into the vehicle contained receptacle 28 by control means 32 such that the volume of fuel and the inert gas remaining within the ullage of the vehicle contained receptacle(s) 28 is optimal for the safety of the aircraft's departure and its subsequent flight. Alternatively, control means 32 can pump inert gas into the ullage of aircraft 24 before departure (such as aircraft on shorter flight s having larger ullage volumes) whether the aircraft employs the aforenoted inert gas enriched fuel, or conventional hydrocarbon fuel. In a second arrangement, a plural conduit can be employed to provide for the bi-directional and simultaneous conveyance of receptacle-content. For example, as inert gas is conveyed in a conduit in one direction, fuel is conveyed in another conduit in the opposite direction, (and an exchange of inert gas volumes is facilitated as the entering fuel forces out the gas). Hence, the safety feature of the system is further facilitated during simultaneous bi-directional exchanges of receptacle-content as concentrations of inert gas in corresponding receptacles are monitored, exchanged and optimized. This arrangement is further illustrated in FIG. 16 wherein a receptacle 12 containing a hydrocarbon fuel volume 34 and inert gas volume 36 thereabove and having receptacle-condition monitoring means therein, is transported in air tanker vehicle 40, and a vehicle contained receptacle 28 in vehicle 22 (aircraft 24) containing a hydrocarbon fuel volume 34 and a inert gas volume 36 thereabove having receptacle-condition monitoring means therein is being fueled by the tanker via connectable conduit ends 20 at conduit coupling 16 with receptacle-content being conveyable through a single or plural passageway conduit by content control means 32. Thus, inert gas conveyance means and hydrocarbon fuel conveyance means are facilitated in the fuel safety management system of the present invention whether the receptacles are ground-based or transportable, and include the means to transport and transfer chilled inert receptacle-content of a type which can be stored in a temperature range which is within temperature tolerance ranges of conventional commercial aircraft.

Figure 17:
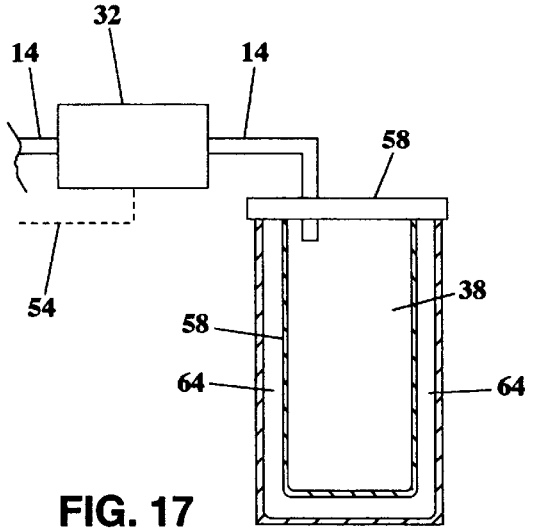
FIGS. 17–20 are cross-sectional side views of compact receptacles of inert medium with a controllable thermal insulation volume shown substantially surrounding the receptacles.
Figure 18:
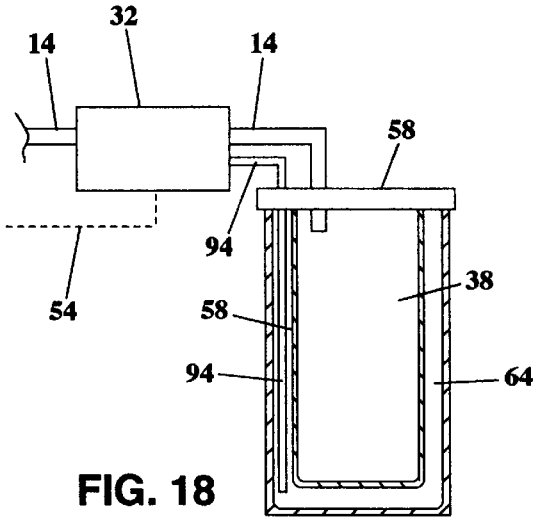
Figure 19:
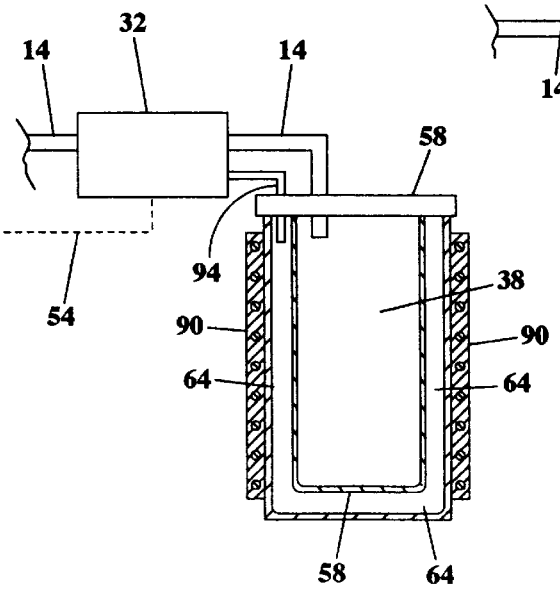
Figure 20:
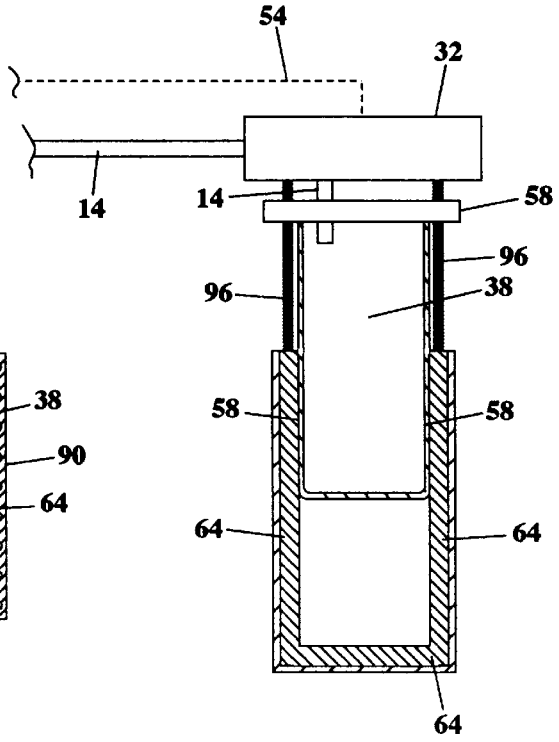

For example, FIGS. 17–20 illustrate inert gas conveyance means comprising at least one compact receptacle 58 of chilled inert medium 38 connected with receptacle-content control means 32 via conduit 14, wherein a controllable thermal insulating volume 64 is seen substantially surrounding each receptacle 58. When the chilled inert medium 38 is comprised of solid or liquid CO2, it is stored at a temperature approximately above minus 70 degrees Fahrenheit, and as shown in FIGS. 18–20, is converted into conveyable inert gas at a desired rate according to adjustments to the insulating volume 64 made by receptacle-content control means 32 which is responsive to communicably linked receptacle-content monitoring means (not shown) via monitoring means signal 54. In FIGS. 17–19, thermal insulation volume 64 comprises a vacuum that is controllable in FIGS. 18 and 19 by receptacle-content control means 32 through insulation-content conduit 94. As negative pressure of the vacuum is reduced through conduit insulation-content 94 by control means 32 (comprising a computer-controlled pump or valve), the insulative characteristic of the vacuum is reduced and the chilled volume is heated causing the release of inert gas therefrom and into conduit 14 at a desired rate where it is further directed as needed by content control means 32. It is noted that the controllable volume surrounding the chilled medium can optionally employ a controllable volume of relatively warmer medium such as fuel (or ambient air) which can be circulated therein. For example, relatively warmer jet fuel can be circulated in the surrounding volume of the chilled medium as need as a heating means to facilitate chilled-state transitions. Futhermore, it is noted that a store of a chilled medium such as solidified CO2 can alternatively be stored in a receptacle suitable for the reception of a warming medium such as fuel, whereby the fuel can be circulated within the receptacle (e.g. among a high surface area of stored dry ice) to facilitate a controlled expansion of the chilled-state medium. Alternatively, as shown in FIG. 19, insulating volume 64, which is seen substantially surrounding compact receptacle 58, can be heated by the employment of at least one heating means such as peripheral heating element 90 (which can comprise any one in a variety of known heating elements, such as an electrically conductive heating element, or a warming element which circulates relatively warm air, gas, or fluids). Alternatively, insulating volume 64 seen in FIG. 20, is seen substantially surrounding compact receptacle 58 and is slideably movable according to adjustments made by control means 32 via linear actuator means 96 (such as at least one stepper motor and lead screw combination) to expose at least one surface area of receptacle 38 to relatively warm air in order to heat the chilled inert volume 38 at a desired rate.

In each of the aforementioned embodiments, an inert gas conveying means is provided to optimize the concentration of inert gas in receptacle ullages which can otherwise become flammable, and provides a safety-enhancing system which will operate within the aforenoted temperature ranges of those considered tolerable by commercial aircraft and other vehicles. As will also be appreciated from the aforenoted description of the embodiments of the invention, including thermally tolerable temperature-range inert media of the system, is comprised to exchange and/or provide inert gas to vehicles using either conventional fuel or the inert gas-enriched fuel of the co-pending patents.

Although the present invention has been described with a certain degree of particularity, it is understood that the present disclosure has been mad by way of example, and changes in detail or structure may be made without departing from the spirit of the invention as defined in the appended claims.

What is claimed is:

1. A means for providing a fuel receptacle safety-enhancing system comprising at least one fuel receptacle, a store of at least one inert gas: and an inert gas conveyance means suitable for transferring said inert gas(es) into the ullage of said fuel receptacle (s), wherein the inert gas is of a type which a.) mixes, is absorbed, or is retained within hydrocarbon fuel in a ratio which exceeds 0.1 volume of gas per volume of fuel;

b.) stores in a temperature range which is thermally tolerable by said fuel receptacle and by conduits connected thereto.

2. The inert gas conveyance means of claim 1 wherein absorbed inert gas is conveyed in liquid hydrocarbon fuel.

3. The inert gas conveyance means of claim 2 consisting of an inert gas-enriched hydrocarbon fuel containing a volume of inert gas which is mixed, absorbed or retained therein and which is conveyable in said fuel by suitable fuel conveyance means into at least one fuel receptacle of a vehicle to substantially degas into the ullage of the receptacle(s) which receives said fuel; wherein said fuel conveyance means is further comprised of a connectable conduit suitable for the transfer of said inert gas-enriched fuel from a supply which is external to said vehicle.

4. The inert gas of claim 1 substantially consisting of gaseous carbon dioxide.

5. The store of at least one inert gas of claim 1 substantially consisting of liquid carbon dioxide.

6. The store of at least one inert gas of claim 1 substantially consisting of solidified carbon dioxide.

7. The inert gas conveyance means of claim 1 consisting of an inert gas-enriched hydrocarbon fuel containing a volume of inert gas which has been mixed, absorbed or retained therein and which is conveyable in said fuel by suitable fuel conveyance means into at least one fuel receptacle to substantially degas into the ullage of the receptacle (s) which receives said fuel according to at least one degassing condition.

8. The fuel conveyance means of claim 7 further comprising at least one conduit connected computer controllable valve.

9. The fuel conveyance means of claim 7 further comprising at least one conduit connected computer controllable inert gas pump.

10. The degassing condition of claim 7 which does occur with sufficient atmospheric pressure change.

11. The degassing condition of claim 7 which does occur with sufficient passage of time.

12. The degassing condition of claim 7 which does occur with sufficient agitation of said inert gas enriched hydrocarbon fuel.

13. The degassing condition of claim 7 which does occur with sufficient temperature change of said inert gas enriched hydrocarbon fuel.

14. The degassing condition of claim 7 which does occur with sufficient non equilibrium between the ullage concentration of inert gas and the concentration of inert gas within said gas-enriched fuel.

15. The inert gas-enriched hydrocarbon fuel of claim 7 wherein a volume of inert gas within said gas-enriched fuel is quickly educted from said fuel by a gas purging means prior to the fuel induction phase of an engine.

16. The gas purging means of claim 15 having at least one controllable opening which directs a pressurized flow of ambient air through a store of said gas-enriched fuel, and at least one controllable opening to channel the escape of inert gas and said pressurized ambient air.

17. The gas purging means of claim 15 comprising at lest one converging/diverging nozzle wherein said gas-enriched fuel is directed therethrough such that inert gas is purged from the fuel and is extracted and vented at the low pressure site of said nozzle.

18. The gas purging means of claim 15 further comprising a connected gas conveying conduit suitable for directing inert gas into at least one gas receptacle of the system.

19. The gas purging means of claim 15 further comprising a connected gas conveying conduit suitable for directed inert gas into at least one fuel receptacle of the system.

20. The gas purging means of claim 15 further comprising a connected gas conveying conduit suitable for directing inert gas into cold fuel contained in at least one fuel receptacle of the system.

21. The gas purging means of claim 15 further comprising a connected gas conveyance means and at least one gas compression and cooling means suitable for cooling the purged inert gas to be stored in a chilled state within a chilled inert gas receptacle.

22. The inert gas store of claim 1 comprising:

at least one gas receptacle to contain said store of at least one inert gas, wherein said gas receptacle(s) and said at least one fuel receptacle are coupled by at least one conduit suitable for the transfer of at least one receptacle-content between said receptacle(s).

23. The fuel receptacle(s) of claim 22 further comprising a receptacle content monitoring means having a suitable communication link with said inert gas conveyance means, such that said monitoring means monitors the ullage content of said receptacle(s) pertaining to the concentration of inert gas needed to achieve a safety-enhanced condition within said ullage and regularly transmits ullage content information to said inert gas conveyance means which in turn, conveys a safety-enhancing supply of inert gas to said receptacle(s) as needed.

24. The inert gas conveyance means of claim 22 further comprising at least one computer controllable valve.

25. The inert gas conveyance means of claim 22 further comprising at least one computer controllable inert gas pump.

26. The gas receptacle(s) of claim 22 wherein at least one of said gas receptacle(s) is suitable for storing chilled gas in a liquefied or solidified state.

27. The chilled gas storing receptacle(s) of claim 26 further comprising at least one computer controllable heating means which facilitates a controllable expansion of said chilled gas.

28. The heating means of claim 27 consisting of a insulative material which substantially surrounds said chilled gas receptacle(s) in a non-heating mode and which is controllably slideable to expose an exterior surface of said gas receptacle to relatively warmer surrounding ambient air to facilitate expansion of said chilled gas as needed.

29. The computer controllable heating means of claim 27 further comprising at least one fuel conveying conduit which conveys a controllable flow of relatively warmer fuel into a store of high surface area solidified CO2 to facilitate a controllable expansion of gas from said store.

30. The conduit of claim 22 further comprising multi-passageways, wherein each of said multi-passageways is suitable for the conveyance of at least one receptacle-content.

* * * * *